United States Patent [19]

Hawkins

[11] Patent Number: 4,890,778

[45] Date of Patent: Jan. 2, 1990

[54] HAMMER-ACTIVATED FASTENER TOOL FOR DRIVING FASTENER PROJECTILES

[76] Inventor: Robert E. Hawkins, P.O. Box 430, Arcadia, Ind. 46030

[21] Appl. No.: 188,455

[22] Filed: Apr. 29, 1988

[51] Int. Cl.[4] ..... B25C 1/14

[52] U.S. Cl. ..... 227/10; 227/8

[58] Field of Search ..... 227/8–10, 227/149

[56] References Cited

U.S. PATENT DOCUMENTS

| | | | |
|---|---|---|---|
| 3,297,224 | 1/1967 | Osborne | 227/10 |
| 3,399,817 | 9/1968 | Diehl | 227/10 |
| 4,025,029 | 5/1977 | Kotas et al. | 227/10 |
| 4,252,259 | 2/1981 | Brosius | 227/10 |
| 4,651,912 | 3/1987 | Hawkins | 227/8 |

*Primary Examiner*—Douglas D. Watts

*Assistant Examiner*—James L. Wolfe

*Attorney, Agent, or Firm*—Robert A. Spray

[57] ABSTRACT

A power-actuated fastener tool for the driving of a fastener object into hard material such as concrete or metal, the tool being of a type having a relatively movable barrel and housing components, the barrel carrying a power load chamber body and a relatively movable piston member which in muzzleward movement drives the fastener object, and on breechward movement achieves ejection of the spent power load cartridge; and the housing carries a movable firing pin assembly. The housing is provided with an offset axially-extending wall, and its opposite ends serve as abutments cooperative with a transverse pin, carried by the piston and extending through a slot in the barrel wall, to achieve various operative features.

55 Claims, 5 Drawing Sheets

HAMMER-ACTIVATED FASTENER TOOL FOR DRIVING FASTENER PROJECTILES

This invention relates to power-activated hand tools for the driving of a fastener projectile by means of an explosion of a power load, as the tool is struck by a hammer.

More particularly, the invention relates to improvements over a tool of such description, which is the subject of this same inventor's U.S. Pat. No. 4,651,912, issued March 24, 1987. The tool provides a means for the hammer-actuated driving of fastener projectiles, and in basic concept is indeed a worthy and desirable tool for that use. Earlier tools, of hammer-actuation type and of trigger-actuation type, as cited in that patent, illustrate a long history of power-actuated fastener tools; and they have been long-used and widely-used in the construction and building trades industry.

However, as set forth herein, the present invention concepts provide significant advantages over this inventor's prior patent and other tools of the prior art. Those advantages, both of concepts and of construction features, are described in detail herein, showing novelty and differences in construction, concepts, and advantages of the present invention over the tool of that patent in significant respects. Those advantageous differences of the present invention, over the embodiments of prior art tools and over the embodiment of the tool shown in that patent, are introductorily summarized prior to a detailed description.

INTRODUCTORY SUMMARY OF DETAILS OF NOVELTY OVER THE PRIOR ART

The present invention provides details and achieves advantages over the prior art, by novel concepts providing not only newness of details and concepts but novel relation and co-operation between the tool's basic elements of housing, its barrel, chamber body, firing pin, and piston, by a special-effect offset wall of the housing and its end abutments, by two special-effect access openings, by a special-effect slot in the barrel, by a special-effect and multiple-effect pin carried by the piston but operative also upon the barrel and the housing, by special-effect grooves and retainer ring features of the firing pin's control body, by a special-effect spacer sleeve fixed to the housing, by a special-effect sliding pin carried by the chamber body, by special effect means of retaining that sliding pin yet permitting is operativity of preventing jamming, by a special nature end wall of the housing, etc., all individually advantageous and especially advantageous in their combination effect.

Various concepts and components are conceded and emphasized to have been attempted in this long-developing art, including the earlier invention of this same inventor; nevertheless, with the prior art not having had such concepts as here presented and as shown as different from the prior art, even only a fair amount of realistic humility, to avoid consideration of the various concepts of this invention improperly by hindsight, requires one or more of the present concepts here to be realistically viewed as inventive in their nature.

BRIEF DESCRIPTION OF THE DRAWINGS

The above description of the novel and advantageous hammer-activated power tool device having concepts of the present invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts of the present invention as are illustrated in this embodiment.

General description of the views shown by the Figures of the drawings:

FIG. 3 shows the tool in an open or loading condition, with the power load and fastener installed;

FIG. 4 shows the tool pushed together and placed against the work object's surface, although just lightly, as in a step of locating the tool's muzzle to the desired placement desired for installation of the fastener into the work object;

FIG. 5 shows the fastener as in FIG. 4 but with the parts now being held in the cocked or firing position, with the tool's firing pin exposed, by the user pushing on the housing and/or the tool handle, thus pushing the tool muzzle against the work object;

FIG. 6 shows the parts during the firing actuation, by a hammer imparting a forceful blow to the firing pin, and with the cartridge having been exploded, and the explosion having driven the fastener into the work object;

FIG. 7 shows the tool in the stage of ejecting the spent cartridge shell or load, by pulling the housing and barrel axially relatively apart; but FIG. 7 is also a composite view in that, with the parts in that same relative position of the barrel and housing (which also is that same relative position of those components in FIG. 3, being in open condition), it shows a procedural step of using a nail to depress the retainer pin to achieve a release of the barrel from the housing, as in FIG. 8, but the retainer pin being depressed inwardly far enough to clear a retainer shoulder on the housing;

FIG. 11 is an elevation view of the modified chamber body member, as viewed from its breechward face;

FIG. 12 is a half section view of the modified chamber body member of FIG. 11, the upper portion being shown as cut away, all generally as per Section-line 12—12 of FIG. 11, to show the upper portion in axial cross-section to more clearly illustrate the slidable force-pin and its retention;

FIGS. 13 and 14 are longitudinal or axial cross-sectional detail views of the tool of FIGS. 1–10, except showing the tool provided with a modified chamber body member and pin of FIGS. 11 and 12, and tool components both breechward and muzzleward thereof, to illustrate operativity; and more particularly:

FIG. 13 illustrates the tool generally in the condition of that of FIG. 4, with the pin of FIGS. 11 and 12 having been pushed or held muzzlewardly and forcing the piston to be relatively muzzlewardly far enough that the ejector pin cannot be or move to a position so far breechwardly as to jam against a power load in the chamber body nor even far enough breechwardly to prevent the needed instantaneousness of spread of the gas from a power load firing to reach the fullness of the piston area in contrast to merely that of the piston's ejector pin; and FIG. 14 illustrates the pin of FIGS. 11–13 having been pushed or held breechwardly by the breechward force of the piston, the tool being generally in the ejection condition of that of FIG. 7, showing the ejection of a spent power load cartridge by the housing and barrel having moved relative together axially far enough to have caused the ejector pin to have ejected the spent power load casing, and showing the operativity of the pin of FIGS. 11–13 to be such that when the piston is so bar breechwardly that the ejector pin is in the chamber body's power load bore, or in either of the positions relative thereto as described for FIG. 13, the firing pin's guide spool is forced or held away from the contact it has with the chamber body in positions such as in FIGS. 4, 5, 6, and 13.

FIG. 15 is an elevation view of the preferred modification of chamber body member, as viewed from its breechward face; and FIG. 16 in a view similar to that of FIG. 12, but of the form of chamber body and slidable pin of the FIG. 15 embodiment, FIG. 16 being a so-called half section view generally as taken by Section-line 16—16 of FIG. 15, illustrating the slidable force-pin and its retention.

DETAILED DESCRIPTION OF THE PREFERRED EMBODIMENT AS ILLUSTRATED

Figures 1, 2, 3, 4, 5:
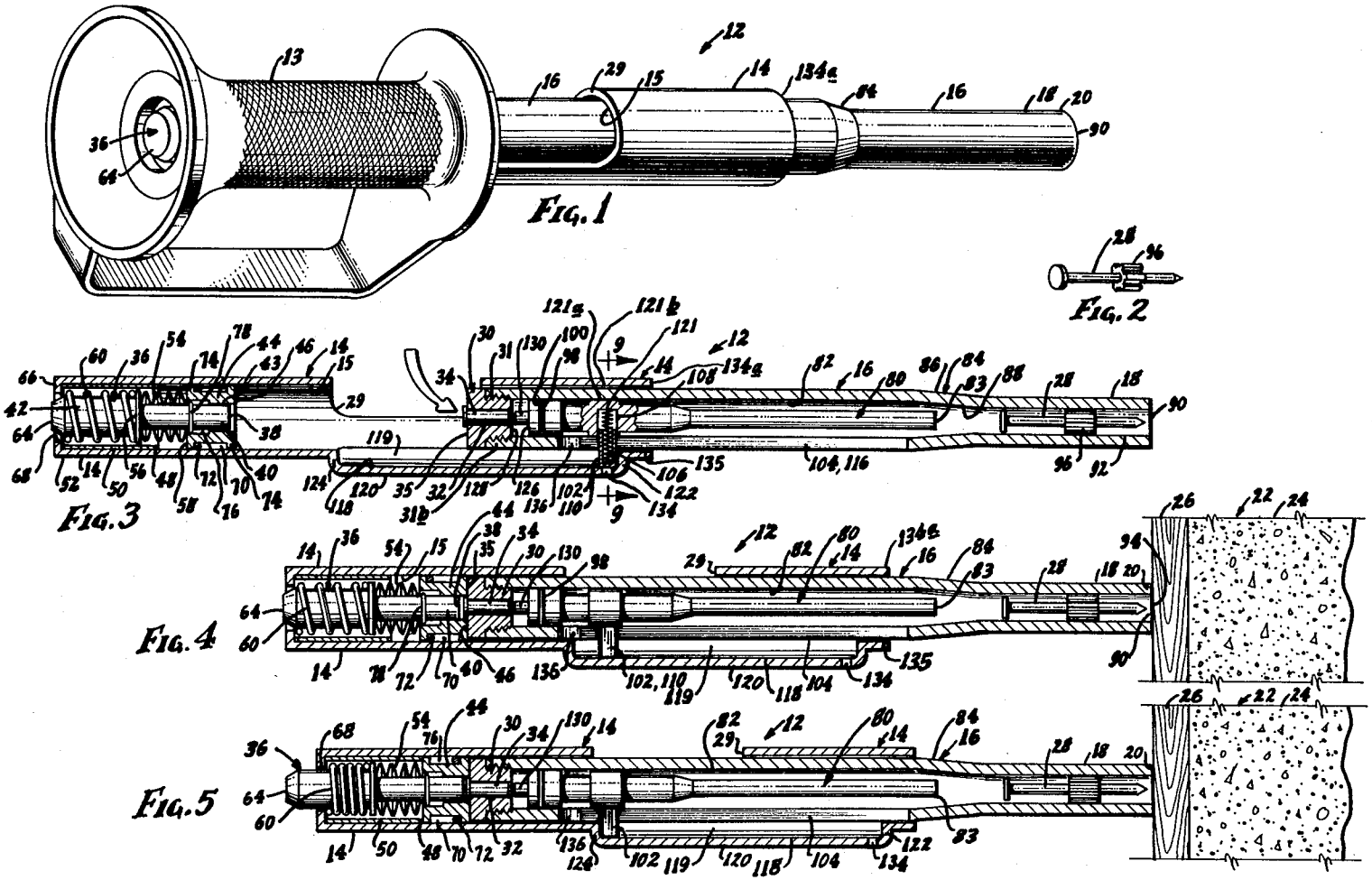
FIG. 1 is an overall pictorial view of a hammeractivated fastener tool embodying the invention.
FIG. 2 is a pictorial view of a typical fastener to be power-driven by the tool of FIG. 1, the fastener shown with a plastic nail-holder device which supports the fastener in the barrel muzzle.
FIG. 3–7, all of the same scale, are longitudinal cross-sectional views of the fastener tool of FIG. 1, showing different stages of sequences in the use of the tool in firing the power load or cartridge shown in FIGS. 3–6 to drive the fastener device of FIG. 2 into a work object shown in FIGS. 4–6; and more particularly.

As shown in the drawings, the present invention provides a hammer-actuated fastening tool which in many respects is similar to that of U.S. Pat. No. 4,651,912, but which has advantages thereover as herein set forth.

Figure 10:
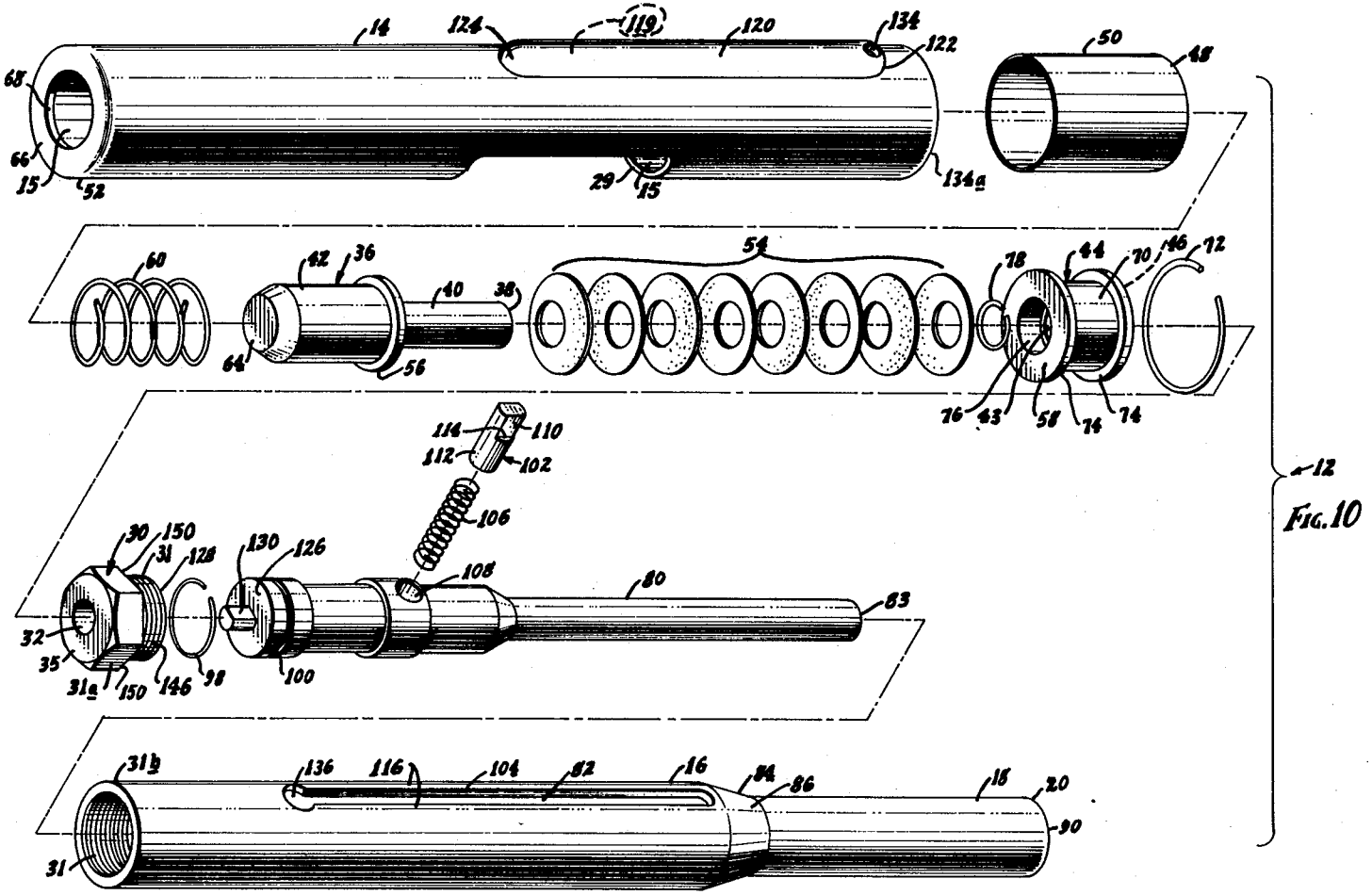
FIG. 10 is an exploded view of the overall assembly of most of the components of the tool as shown in the other Figures, particularly for ease of identification of the components.
Figure 13:
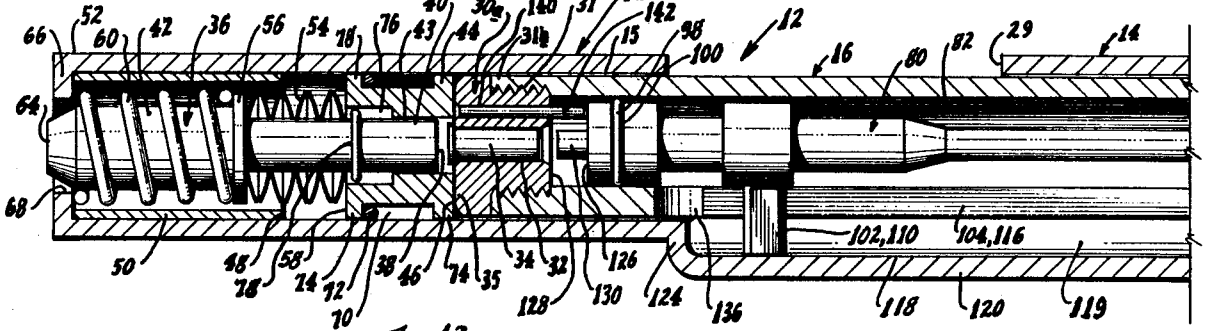
FIGS. 11–14 illustrates, in a scale larger than for FIGS. 3–8, although slightly smaller than for FIG. 9, a modified chamber body member for the tool of FIGS. 1–10; and more particularly.
Figure 11:
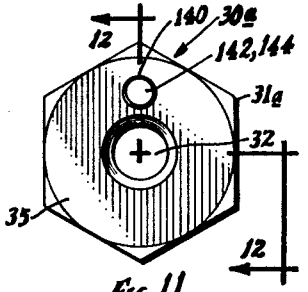
Figure 14:
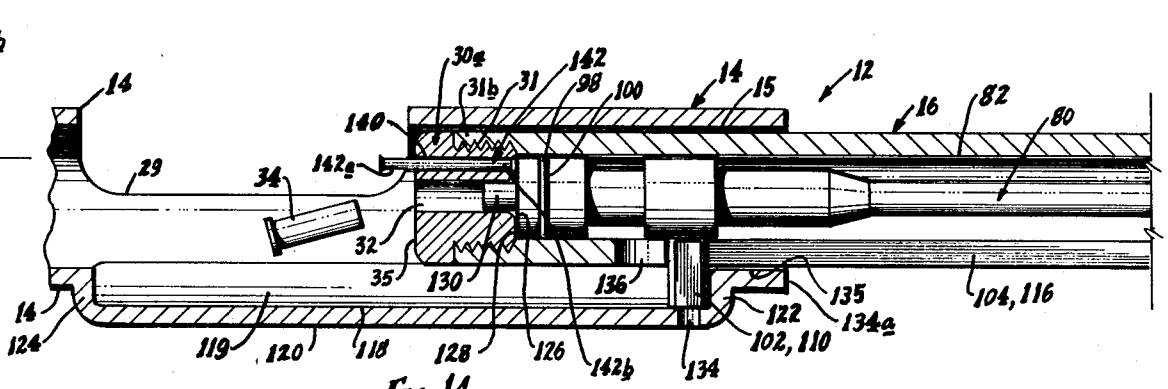

Preliminarily, however, it is mentioned that the pictorial FIG. 10 illustrates many of the basic components; and thus it is reminded that FIG. 10 may be used for convenient reference even though it does not illustrate the activation or action features. Also, introductorily, it is reminded that in all views of FIGS. 1,3–8, and 10, the orientation of the tool is consistently the same, i.e., the muzzle is at the right, and the breech is at the left; and thus "muzzleward" indicates forwardly or rightwardly, and "breechward" indicates rearwardly, or leftwardly as the drawings are being considered.

Also, to avoid undue overcrowding of reference numerals, and because the several views show the correspondency of parts quite clearly, the duplication of reference numerals on the several views is kept at what seems to be a minimum consistent with convenience of reference and understanding.

Figure 15:
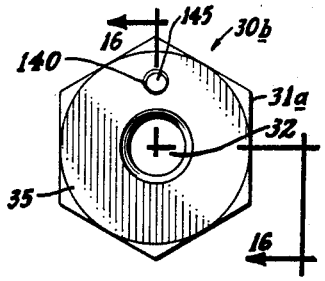
FIGS. 15 and 16, in the scale of FIGS. 11–14, illustrate a preferred modification of a power load chamber body member for the tool of FIGS. 1–10, and more particularly.
Figure 16:
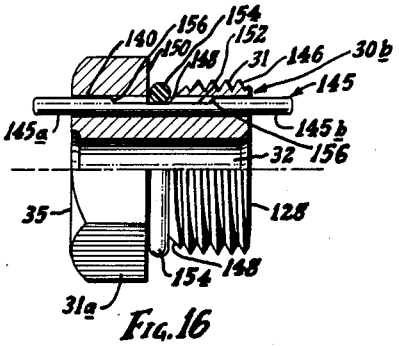

More particularly as to the tool as shown in the drawings, the present invention provides a hammer-actuated fastening tool with components here listed in summary form for convenience:

12 overall fastening tool
13 handle
14 tubular housing
15 bore of housing 14
16 tubular barrel
18 muzzle of barrel 16
20 forward end of muzzle 18
22 associated work-object
24 concrete of 22
26 wood of 22
28 fastener member
29 access cutout in housing 14
30 chamber body for power load 34
**30*a* chamber body of FIGS. 11–14**
**30*b* chamber body of FIGS. 15 and 16**
31 threads connecting barrel 16 and 30
**31*a* hex body of chamber body 30**
**31*b* rear end of barrel 16**
32 axial bore of chamber body 30
34 power load
35 rear face of chamber body 30
36 firing pin
38 firing pin forward or striker face
40 forward portion of firing pin 36
42 rearward portion of firing pin 36
43 bore of guide body 44
44 firing pin guide spool
46 front face of guide body 44
48 front shoulder of sleeve 50
50 rear sleeve in housing bore 15
52 rear end of housing 14
54 inner spring for firing pin 36
56 shoulder centrally of firing pin 36
58 rear face of guide body 44
60 rear spring for firing pin 36
62 hammer for actuating
64 rear end of firing pin 36
66 flange inturned of housing-end 52
68 central hole of flange 66
70 groove on outside of guide 44
72 retainer ring in groove 70
74 end walls of groove 70
76 counter bore in guide body bore 43
78 retainer ring in counter bore 76
80 piston
82 bore of barrel 16
83 piston 80's right end
84 taper at muzzle 18
86 outer wall of barrel 16 at muzzle 18
88 inner wall of barrel 16 at muzzle 18
90 hole at right end of muzzle 18's end 20
92 bore at muzzle end-portion 20
94 work-object's entrance location
96 support body for fastener 28
98 retainer ring in piston groove 100
100 groove in piston 80 for ring 98

102 retainer pin radially of piston 80 through barrel slot 104
104 long slot in barrel 16
106 spring for pin 102
108 recess for spring 106 and pin 102
110 outer portion of pin 102 (its flats)
112 inner pin portion of pin 102
114 shoulder on pin 102
116 edges of slot 104
118 inner wall of offset wall 120 of housing 14
119 internal groove of wall 120
120 offset wall
121 bottom of hole 108
121*a* retaining contact of piston 80 and barrel 16
121*b* retaining contact of barrel 16 and housing 14
122 muzzleward shoulder of offset wall 120
124 breechward shoulder of offset wall 120
126 piston 80 rear face
128 inner face of chamber body 30
130 ejector pin of piston 80
132 associated nail for disassembly
134 hole in offset wall 120
134*a* housing 14's muzzleward end
135 inner wall of housing 14
136 slot-end hole for assembly, disassembly of pin 102
140 supplementary bore in chamber body 30*a* and 30*b* for pin 142
142 pin slidable in bore 140 of 30*a*
142*a* pin 142's breechward end
142*b* pin 142's muzzleward end
144 head on each end of pin 142
145 pin slidable in bore 140 of 30*b*
145*a* pin 145's breechward end
145*b* pin 145's muzzleward end
146 threaded muzzleward portion of 30, 30*a*, and 30*b*
148 annular groove in 146 for retainer ring 154
150 muzzleward face of chamber body head 31*a*
152 central flat of pin 145
154 retainer ring in groove 148, for flat 152
156 and walls of flat 152 of pin 145

THE TOOL'S GENERAL PARTS AS CONSPICUOUS EXTERNALLY, AND AN ILLUSTRATIVE USE OF THE TOOL

The tool 12 is shown as having a handle 13 of sturdy plastic, which by a tight fit is fixedly connected to a tubular receiver or housing 14; and slidably carried within the bore 15 of the housing 14 is a tubular barrel member 16 whose forward end carries the tool's cylindrical muzzle 18. (The parts identified in this paragraph include the exterior parts most easily seen as the tool 12 is viewed in use; and, in such use, the tool 12 is held such that the forward end 20 of the muzzle 18 is held against the associated work-object 22.)

As shown, the work-object 22 is shown as a portion of concrete 24 having a piece of wood 26 on its face; and the general object of the use of the tool 12 in this illustrative use is to cause a fastener member 28 (FIGS. 2–6) to be powerfully driven through the wood 26 and into the concrete 24.

For hopeful convenience of understanding the tool 12, its description will be given in two general parts, i.e., those components on the left and the right, respectively, of the housing's large cutout opening 29 in FIG. 3; and then more operativity and concept details will be detailed.

GENERAL DESCRIPTION OF BASIC INTERIOR COMPONENTS FOR FIRING A POWER LOAD, BY A FIRING PIN ASSEMBLY, IN THE HOUSING

Considering here particularly FIGS. 1,3 and 10 for a general description of basic interior components in this embodiment of the tool 12, it will be seen that the slidable barrel 16 carries at its breechward (left) end a chamber body device 30, the chamber body 30 and the barrel 16 being screw-threadedly connected at 31, and having a hexagonal rear body portion 31*a* for ease of assembly and disassembly from the rear or breechward (left) end 31*b* of the barrel 16.

The chamber body 30 has an axial bore 32; and a power load or cartridge 34 is shown by the indicator arrow in FIG. 3 as having been inserted into the bore 32 of the chamber body 30, access to the chamber body 30 being by a large cutout 29 of the tubular housing 14.

An outer rim on the rear end of the power load 34 abuts the rear face 35 of the chamber body 30, when the load 34 is in the chamber body's bore 32, preventing movement of the power load 34 muzzleward (rightwardly) from the loaded position of the power load 34 as shown in FIGS. 3–6.

For firing the power load 34, a generally cylindrical firing pin body 36 is shown in the housing bore 15 leftwardly (rearwardly) of its cutout area 29; and the firing pin 36 is shown as a cylindrical member having a firing pin striker face 38 at its muzzleward (right) end, on a cylindrical forward portion 40 of the firing pin 36. Leftwardly (rearwardly) of the forward firing pin portion 40 is a rearward firing pin portion 42. The firing pin 36 is slidably carried in the bore 15 of the housing 14, as more fully noted below.

The front or muzzleward portion 40 of the firing pin 36 is ensleeved in and slidably carried in the axial bore 43 of a generally cylindrical and spool-like guide or firing pin control body 44, which itself is slidably carried in the hollow bore 15 of the housing 14 for movement axially of that housing bore 15, being biased muzzlewardly (rightwardly) by spring means detailed below.

The bore 43 of the guide body 44 thus movably supports the front portion 40 of the firing pin 36 generally axially of the housing bore 15; and support of the firing pin 36's larger diameter rear portion 42 is mentioned below.

The firing pin guide 44 is movable relative to housing 14 between a muzzleward or forward position (FIG. 4) in which the front (muzzleward) face 46 of the firing pin 36's guide body 44 is engaging the rear face 35 of the power load chamber body 30 when that body 30 is in the position of body 30 when the barrel 16 and housing 14 are pushed together but not cocked or being fired (although it is farther movable muzzlewardly in housing bore 15 during assembly and disassembly), and an outer or rear position (FIGS. 5 and 6) during those locked or firing conditions in which it is blocked against further rearward travel by abutting against a shoulder 48 of the housing bore 15, which shoulder 48 is shown provided at the muzzleward end of a sleeve 50 tightly fitting in the bore 15 at the outer end 52 of the housing 14, the sleeve 50 thus being a spacer.

Two sets of compression or spring means, axially along and sleeved around the firing pin 36, bias the firing pin guide 44 oppositely, as now described.

The rightward spring means 54, here shown as a set of crowned or so-called Bellville washers 54, sleeved around the forward firing pin portion 40, are bottomed rearwardly against an enlarged shoulder 56 on the firing pin 36 between its forward portion 40 its rearward portion 42, and forwardly against the rear face 58 of the firing pin guide body 44. This spring means 54 biases the firing pin 36 rearwardly, and is relatively quite stiff in comparison to the rear or outer spring 60 next described, because spring means 54 desirably deflects very little even under heavy and dynamically applied force of being struck by a hammer 62 (as in FIG. 6) against the rear 64 of the firing pin body 36.

Figures 6, 7, 8, 9:
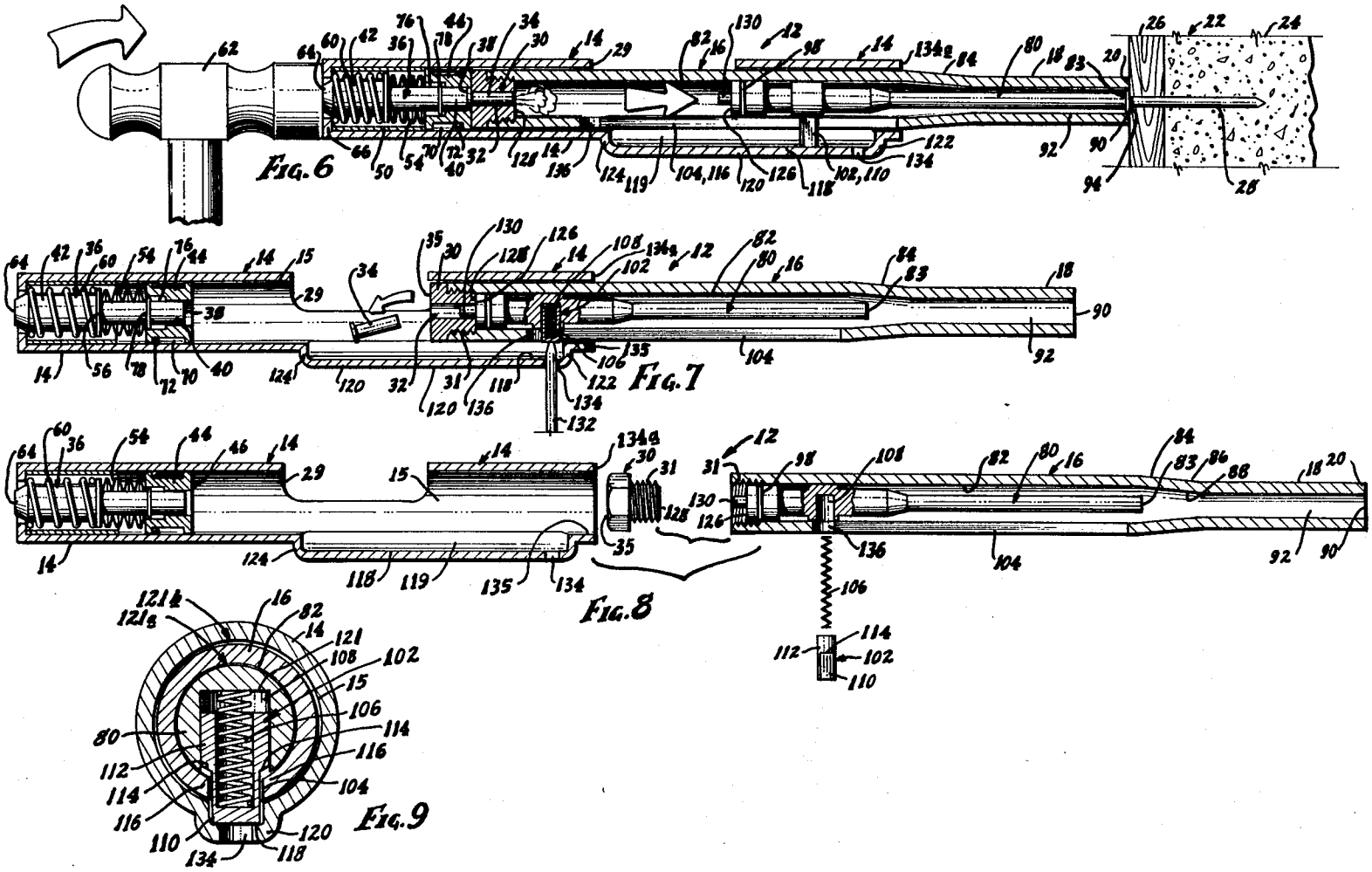
FIG. 8 is a longitudinal cross-sectional view of the tool as in FIGS. 3–7, and on the same scale, but of a exploded view nature to show components separated such as for replacement or servicing of components.
FIG. 9, in larger scale, in a transverse cross-sectional view taken generally on Section-line 9—9 of FIG. 3, particularly to illustrate some of the operativity of the retainer pin.

In contrast, the rear or outer spring means 60 is forward-biasing of the firing pin 36, and is relatively quite weak, so that it will readily yield (compare FIGS. 4 and 5 as to spring 60 and the relative amount of the housing 14 telescopingly overlapping the barrel 16, and the relative exposure of the firing pin's rear end 64 to receive the hammer blow) as the user merely pushes the tool 12 (by pushing the housing 14 and handle 13) inwardly (rightwardly) toward and forcefully against the work object 22, against the bias of spring 60, thus to expose the rear end 64 of the firing pin 36 for the hammer-blow activation shown in FIG. 6.

The rear spring 60 bottoms at its forward end against the firing pin shoulder 56 and rearwardly against an inturned flange or circular lip 66 at the rear end 52 of the housing 14; however, the spring does not bottom in the sense of its coils 60 becoming fully closed or engaging, because of the blocking of that much breechward movement of the guide spool 44 by the spacer should 48. The lip 66 is shown as integral with the wall of the housing 14.

That circular lip's central opening 68 provides a support of loose guide for the rear portion 42 of the firing pin 36; and to facilitate entrance into that hole 68, the rear 64 of the firing pin 36 is beveled, and to avoid a bind-effect enlargement after a plurality of hammer-blows. The support of the firing pin's rear portion 42 need not be to any closeness of fit, however, because of the front support by guide-body 44's bore 43, and whatever support happens by the spring means 60 and 54.

Also, as to the firing pin 36 and its assembly into the housing 14, a pair of retainer features are now mentioned.

That is, the firing pin guide body 44 is shown as having an axially extending annular groove 70 on its radially outersurface, and this receives a retainer ring 72 between the groove's end walls 74 of the guide body 44. The ring 72 provides frictional drag against the housing bore 15, axially retaining the firing pin guide body 44 in place so that it and the spring-sets 54 and 60, and firing pin 36, will not fall out when the barrel 16 and housing 14 are pulled relatively apart, i.e., pulled apart to a position of FIGS. 3, 7, or 8.

The firing pin guide or control body 44's end walls 74, and the retainer ring 72 (which is a resiliently deformable body compressed diametrically in assembly so as to bear outwardly against the housing bore 15 to achieve the axial drag mentioned) are close enough in outer diameter in comparison to that of the housing bore 15 that the spool 44 is kept generally centered in the housing bore 15; and since the spool body bore 43 is only slightly (running fit) larger than the diameter of the muzzleward portion 40 of the firing pin 36, the firing pin guide body 44 serves a general centering effect for the firing pin 36. As mentioned above, however, no closeness of fit or close centering is needed.

The other retainer feature as shown in the assembly involving the firing pin 36 is the provision of an axially-extending counter bore 76 along a rear portion of the firing pin guide body bore 43. This counter bore 76 receives a retainer ring 78 which is tight on the firing pin's forward portion 40, and whose function is to retain the compression means 54 on that pin-portion 40 during assembly into the housing bore 15; and the axial extent of the counter bore 76 accommodates the muzzleward travel of the ring 78 on pin-portion 40 as (FIG. 6) the firing pin 36 moves muzzleward (and thus rightwardly with respect to the firing pin guide or control body 44) during the hammer-blow actuation.

Thus, all parts outwardly of the power load chamber body 30 are seen to co-operate as to the cocking and firing actuation. Next is described the piston 80, which is the component which strikes and drives the fastener 28, and parts relating to the piston 80 and its operativity.

THE POWER PISTON, AND RELATED PARTS

During the operations of loading (FIG. 3), the locating (FIG. 4) of the muzzle 18 onto the workpiece 22, and the cocking (FIG. 5), and just until the instant of the firing shown in FIG. 6, the piston 80 rests in the bore 82 of the barrel 16, in a breechward location explained below; and the effect of the firing of the power load 34 (FIG. 6) by the hammer 62 striking the rear face 64 of the firing pin 36 is to forcefully drive the piston 80 from its outer or breechward position (FIGS. 3–5) axially of the barrel bore 82 muzzlewardly, its right end 83 thus forcefully striking the fastener member 28 and forcefully driving the fastener member 28 into the work object 22.

In such travel, the piston 80 and the fastener member 28 travel axially in the bore 82 of the barrel 16; and as shown there is provided an integral and muzzlewardly-closing taper 84 of the barrel 16's muzzle 18, both as to its outer wall 86 and its inner wall 88, just breechwardly of the muzzle 18, and of course the taper stops well short of the muzzle end 20, leaving the end 20 of the muzzle 18 open at 90 for exit of the fastener 28 at the end of a cylindrical bore-end portion 92 in which the fastener 28 is supported for its projectile movement outwardly through and out of the muzzle end 90. The lesser diameter as provided by the taper 84 also provides a more exact locating of the entrance location 94 of the fastener into the work object 22 even though the breechward end 31*b* of the barrel 16 is larger diameter for reasons of better size of the several other parts and for increased projectile force from the power load 34 due to a larger area against which the force of the explosion acts breechwardly of the piston 80.

The fastener member 28 (FIGS. 2–5) is shown supported or stabilized while in the muzzle end-bore 92 by a light plastic support body 96 (unless the fastener 28 is a body which is supported merely by having a uniform diameter at both its ends), but the support body 96 is effectively disintegrated by the power of the fastener 28 being driven into the work object 22; and thus the support body 96 is not even shown in FIG. 6.

Prior to the firing, i.e., as in FIG. 5 in contrast to FIG. 6, the piston 80 is held frictionally in its breechward location (FIGS. 3–5) by two retainer features. The most forceful such retainers is a retainer ring 98 which is held in an annular groove 100 near the breechward (left) end of the piston 80, the ring 98 frictionally engaging the inner wall 82 of the barrel 16; and although this retainer ring feature 98/100 holds the piston 80 against inadvertent sliding breechwardly, it is not so strong as to significantly retard the power stroke of the piston 80 when the load 34 is fired.

Retaining of the piston 80 in the barrel 16's bore 82 is also somewhat helped (although to much less extent for reasons mentioned below), by a retaining pin 102 (FIGS. 3–10, expecially FIGS. 9 and 10), which extends through an elogated axially-extending slot 104 in the wall of the barrel 16 and is spring-pressed outwardly by a spring 106 and extends radially outwardly (downwardly in the views of FIGS. 3–9) of a radial recess 108 in the piston body 80.

More particularly, the pin 102 has a frictional engagement which serves to provide frictional drag of the piston 80 with respect to the barrel 16, although as mentioned above much less than that of the retainer ring 98.

That is, the retainer pin 102, which as shown is generally cylindrical, has its outer portion 110 cut away (FIGS. 8–10, expecially FIG. 9) to provide a smaller diameter flat-faced portion 110 to be of a size between its flats 110 slightly less than the width of the barrel slot 104. Thus, the pin 102 at the junction of its inner portion 112 and its outer portion 110 has an outwardly-facing shoulder 114 which (as is the entire pin 102) is biased by the spring 106 outwardly of the barrel 16 along the edges 116 of the barrel slot 104; and the size of the flat-face portion 110 outwardly adjacent the pin's shoulders 114 provide that the pin 102 (carrying with it the piston 80 of course by the pin 102 being in the piston's transverse hole 108) may more axially of the barrel slot 104.

It should be noted, however (FIG. 9) that the dimensions are such that the shoulders 114 do not touch the barrel bore 82 during the outer pin-end 110 operativity now specified, although in other instances they do, as explained below.

The outer portion 110 of that retainer pin 102 is of course similarly biased radially outwardly by the pin-spring 106, toward and against the inner wall 118 of an internally facing axially-extending groove 119 provided by an offset wall 120 (offset for reasons mentioned below) of the housing 14, which wall 120 axially extends generally along the span occupied by the barrel 16's slot 104 when the barrel 16 and the housing 14 are in the tool's closed condition (FIGS. 4–6) of locating, cocking and firing of the tool 12.

As best to be noted in FIG. 9, the spring 106 of the retainer pin 102, by that pin 102's push of its outer end 110 against the inner wall 118 of the offset wall 120, gives a reaction push against the bottom 121 (shown in the drawings as at the top, however) of recess hole 108 of the piston 80, thus pushing (upwardly in FIG. 9) the piston 80 (at 121*a*) against the barrel bore 82, and thus also pushing (at 121*b*) the barrel 16 against the housing 14's bore 15, thus serving a retaining function of frictionally resisting sliding of the piston 80 relative to the barrel 16, and resisting sliding of the barrel 16 relative to the housing 14.

The housing 14's offset wall 120 provides two other functions in the form shown, both relating to the wall shoulders by which the wall 120 is offset, as now specified, those shoulders being a muzzleward shoulder 122 and a breechward shoulder 124, respectively blocking the ends of the internal groove 119.

The muzzleward shoulder 122 of the offset wall 120 provides a radially-extending abutment or stop against which the retaining pin 102 abuts (FIG. 3 and FIG. 7 except that in FIG. 7 that view is also showing a disassembly step) to limit the outward, i.e., axial sliding travel of the barrel 16 and housing 14 relative to one another; and the engagement of the pin 102 and muzzleward shoulder 122 also assures that even if prior action has caused the piston 80 to be at all muzzleward (as e.g., shown in FIG. 6) of its breechward condition (FIGS. 3–5), which breechward condition is needed for the piston 80 to achieve the full effect of the explosion of the power load 34, the opening movement of the tool 12 (i.e., a relative apart movement of the barrel 16 and housing 14) will cause the housing 14 to act through the muzzleward shoulder 122 to engage the pin 102 and pull the pin 102 and thus the piston 80 breechwardly.

EJECTION

That breechward movement of the piston 80 continues until the relative opening movement of the barrel 16 and housing 14 (as caused by that engagement 122/102) has moved the piston 80, in breechward movement of the piston 80, so far (FIGS. 7 and 10) that the rearward face 126 of the piston body 80 has engaged the muzzleward face 128 of the chamber body 30.

This (FIG. 7) is the load-ejector position; for as the faces 126 and 128 are coming into contact (FIG. 7), the ejector nib or pin 130, which is centrally and rearwardly (breechwardly) extending from the rear face 126 of the piston body 80, has entered (leftwardly) into the bore 32 of the chamber body 30, forcing the spent power load causing 34 outwardly (rearwardly) of the chamber body 30 and out of the tool 12's housing 14 through its access cutout 29.

While considering that FIG. 7 or ejection view of the open-relation condition of the barrel 16 and the housing 14, it will be noted that disassembly of the barrel 16 and housing 14 is easily achieved. That is, disassembly of the barrel 16 and housing 14 requires merely the push of an associated nail 132 or similar article through a hole 134 in the housing groove 119's offset wall 120, pushing the retainer pin 102 inwardly (upwardly as shown) against the bias of the spring 106, far enough (FIG. 7) to clear the muzzleward shoulder 122, thus releasing the barrel 16 from the housing 14 to slide completely apart (FIG. 8), past the muzzleward end 134*a* of the housing 14, if desired for servicing. That hole 134 is shown adjacent the wall 120's muzzleward shoulder 122; and that shoulder 122 is shown extending inwardly clear to the inner wall 135 of the housing, wall 135 being the extreme muzzleward end of the housing bore 15, muzzleward of the abutment 122 and of all of the offset wall 120 and of its groove 119.

In that disassembly, the pin 102 is restrained from being forced completely outwardly of the hole 108 by the pin 102's shoulders 114 engaging the barrel bore 82 at the slot 104's edges 116, the shoulders 114 thus serving as abutment lugs; for the barrel 16 separated from the housing 16 (unlike FIG. 9) the surface 118 of wall 120 is no longer holding pin 102 inwardly with pin-shoulders 114 away from the barrel bore 82.

If further disassembly is desired, the pin-assembly hole 136 which is at the breechward end of the barrel slot 104, and of a diameter slightly more than that of the retainer pin 102, may be used; for the hole 136 is thus large enough that there are no slot-edges 116 which would block movement of the pin 102 and its shoulders 114 from being pushed completely outwardly of the barrel 16.

Preventing inadvertent manipulation which would register (FIG. 8) the piston-hole 108 and the slot-hole 136, in which case the stored energy of spring 106 would cause the pin 102 to "fly out" of the holes 108 and 136 and be thus possibly lost, the access hole 136 of the barrel slot 104 is far enough breechwardly (FIGS. 7 and 8) that registration of holes 108 and 136 cannot be achieved unless the chamber body 30 is unscrewed somewhat so that (compare FIGS. 7 and 8 as to how far the breechward end 126 of the piston 80 is with respect to the barrel's threads 31 for chamber body 30) the user would be quite consciously aware that the barrel 16 and housing (FIG. 8) were in such a disassembly stage that the pin 102 could and would be propelled radially outwardly from the barrel 16, as in FIG. 8, so the user could of course manually monitor and guard against possible loss of the pin 102.

Returning now to description of the housing 14's abutment shoulders, and now considering particularly the breechward (left) shoulder 124 (and noticing particularly the cocked condition of FIG. 5 in comparison to the pre-cocked condition of FIG. 4 in which the closing of housing 14 and barrel 16 has already brought the firing pin's guide 44 into contact with the rear or outer face 35 of the chamber body 30), it will be noted that in the user's tool-cocking step of pushing the housing 14 rightwardly toward the work 22 to cock the tool 12 the relative leftward movement of the barrel 16 with respect to the housing 14 carries with the barrel 16 the piston 80 (leftwardly relative to the housing 14) until the piston's retainer pin 102 abuttingly engages that breechward wall-shoulder 124, at which blocked condition (FIG. 5) the piston 80 can no longer be carried by the barrel 16 relatively leftwardly; and the blockage 124/102 prevents the piston 80 and its ejector pin 130 from moving relatively leftwardly into the chamber body bore 32, when either the barrel 16 is continued to move relatively leftwardly to the cocked position of FIG. 5 with the outer (left) face of the firing pin 36's guide spool 44 contacting the shoulder 48 at the muzzleward end of the spacer sleeve 50, or during the piston 80 recoil (after a firing) before the firing pin 36's assembly containing its guide spool 44 has been pushed out of the way by the resilient backward section of the inner compression means 54, in which event a spent cartridge 34 could be crushed in chamber bore 32 and made difficult to remove.

OTHER CHAMBER BODY CONCEPTS, OF FIGS. 11–14

FIGS. 11–16 illustrate preferred chamber body concepts which provide further assurance against jamming a power load 34 in the bore 32 of the chamber body 30.

More particularly in the modification shown in FIGS. 11–14, the chamber body 30*a* is shown provided with a supplemental axial hole 140, extending (of course offset from the central of power load bore 32) fully through the body 30*a* from its breechward (left) face 35 to its muzzleward (right) face 128; and in the hole 140 is carried a post-like pin member 142 of an extra length, i.e., significantly longer than the length between the chamber body 30*a*'s faces 35/128 such that an end-portion 142*a* (breechward) or 142*b* (muzzleward) of the pin 142 will always extend axially of bores 15 and 82, from one or the other of the body 30*a*'s faces 35 or 128.

That extra length of the pin 142 is at least as long as the axial length of the ejector pin 130; and the pin 142 is provided at both ends with a head 144 sufficient to assure retention of the pin 142 in the chamber body 30's supplementary bore 140.

The functional operativity of the pin 142 is as follows: Suppose, as in the cocked condition (FIG. 5) the piston 80 is still in that FIG. 5 position with the ejector pin 130 partially or totally in the chamber body 30's bore 32, or even so far breechwardly that the explosion of the power load 34 cannot instantly relieve itself by the explosive force instantly reaching to the full area of the piston face 126 to instantly force the piston 80 muzzlewardly, there could be a "blowback effect" blowing the spent power load 34 forcefully out of the rear of the chamber body 30's bore 32, causing a jamming type of malfunction, in FIG. 5.

However, preventing that malfunction, and regardless of the position of the pin 142 in the supplemental chamber body bore 140, the closure of the barrel 16 and housing 14 from the FIG. 3 condition to the FIG. 4 condition, i.e., sliding the barrel 18 relatively breechwardly with respect to the housing 14 to bring the firing pin 36's guide spool 44 to the breechward face 35 of the chamber body 30, is going to act (FIG. 13) upon pin-portion 142*a* and cause it to act through pin portion 142*b* to force the piston 80 and its ejector pin or nib 130 muzzlewardly sufficient that the ejector pin 130 of the piston 80 is quite clear of the chamber body 30's power load bore 32.

Correspondingly, if the firing pin's guide spool 44's face 46 is (in its FIG. 5 position) against the chamber body 30's breechward face 35, and if there is a spent or unspent power load 34 in the chamber body's power load bore 32, any relative movement (however caused) of the piston 80 breechwardly will act to engage the piston face 126 with the pin-portion 142*b* and cause it to act through the pin portion 142*a* to force the firing pin guide spool 44 leftwardly, thus acting through the inner compression means 54, to keep the firing pin 36 leftwardly to avoid jamming the power load 34 in the chamber body-bore 32, by pushing on firing pin abutment 56, even though the spool 44 cannot be pushed leftwardly due to abutment of its leftward wall face 74 against the shoulder 48 of the bore-sleeve 50.

EMBODIMENT OF FIGS. 15 AND 16

FIGS. 15 and 16 show a more-preferred chamber body 30*b*. Its general resemblance to the chamber body 30*a* of FIGS. 11–14 will be readily apparent from the drawings; and to avoid redundancy its correspondence to the chamber body 30*a* of FIGS. 11–14, including a full-length extra bore 140 parallel to the central axial bore 32 will be indicated merely by this reference and by correspondence of the drawing and reference numerals, except as noted otherwise.

The general difference between the chamber bodies 30*a* and 30*b* is in the way the slidable blocker pin of each (142 of FIG. 11–14 and 145 of FIGS. 15, 16) is retained, as herein explained as to the forms shown; and the function and operativity of the pins 142 and 145 is the same.

A particular difference of chamber bodies 30*a* and 30*b* is that in chamber body 30*b* its muzzleward threaded portion 146 is radially cut or grooved, here shown as by an annular groove 148 adjacent the muzzleward face 150 of the hexagonal chamber body head 31*a* of the chamber body 30*b*, a cut or formation shown radially deep enough in the body portion 146 of chamber body 30b that it intersects the axial hole 140 of that chamber body 30b.

The blocking pin 145 of the FIG. 15 and 16 embodiment is shown provided to have a reduced diameter, and here a flattened, central portion 152; and the annular groove 148 is shown provided with a retainer member here shown as a resilient O-ring 154, which, in the portion of the annular groove 148, is shown in FIG. 16 to be partially disposed in the bore of the axial hole 140 (as accommodated by the flat portion relief of the pin 145 along the region of its flat 152).

Accordingly, the retainer ring device 154, by its partial disposition operatively in the axial hole bore 140 and against flat 152, retains the pin 145 against loss axially outwardly of the chamber body 30b in either direction; for the slidable pin 145 is of a large enough diameter that the end walls 156 of the pin 145's flattened part 152 are radially outwardly of the chamber body 30b far enough to abut against the inner part of the retainer member 154 seated in the annular groove 148, and the pin 145 is positioned in the hole 140 with its flat portion 152 facing radially outward of the chamber body 30b, accommodating there the retainer member 154, as shown in FIG. 16.

Figure 12:
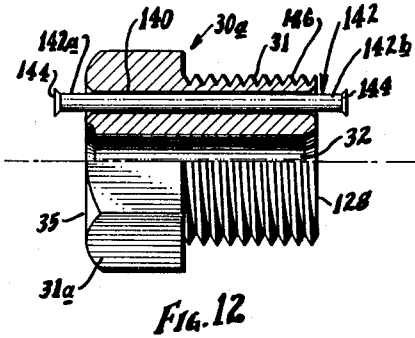

The end walls 156 are generally centrally of the entire length of pin 145, and are spaced sufficiently to permit the pin 145 to be forced fully to either end 35 or 128 of the chamber body 30b, as is the pin 142 of FIG. 12.

The pin 145 needs thus no heading such as the heads 144 of the pin 142 of the embodiment of FIGS. 11–14; for the blocking operativity of 154/156 in both axial directions retains the pin 145 in the chamber body 30b.

Nevertheless, the blocker pin 145 of the FIGS. 15–16 embodiment, being of a specially-elongated length as described as to the pin 142 of FIGS. 11–14, and like it having end-portions 145a and 145b corresponding in nature and operativity to the end-portions 142a and 142b of pin 142 of the embodiment of FIGS. 11–14, the blocker pin 145 performs the functions described as to blocker pin 142 of FIGS. 11–14.

BRIEF SUMMARY OF NOVEL CONCEPTS

The features of this invention provide improvements in safety, operativity and operational consistency, as well as reliability, durability, simplicity and cost savings in manufacturing, assembly and repair, over other and current model tools of this category.

The outer housing 14 with the formed internal groove 119 maintains the barrel assembly 16 in the proper place with respect to the abutments 122 and 124 at each end to co-operate with the piston detent pin 102, thus eliminating the need and dis-advantage of any external screws, spring clips, etc., which are susceptible to breakage which would make the tool 12 inoperable.

The small hole 134 through the housing 14 in the muzzleward end of the groove 119 allows the barrel assembly 16 to be removed by simply depressing the piston detent pin 102 with a nail 132 or other similar object while pulling the housing 14 and barrel 16 apart, thus eliminating the need for any special tools. To reassemble the barrel 16 and housing 14, the user need merely push the piston pin 102 radially inwardly far enough to clear the inner wall 135 of the housing at its muzzleward end 134a, thus also radially inwardly past the muzzleward abutment 122 of wall 120, and then push the barrel 16 and housing 14 axially together, i.e., push the barrel 16 relatively breechwardly and the housing 14 relatively muzzlewardly.

The piston pin 102 is also operative (121a, 121b) to provide a yieldable or releasable holding of the piston 80 in the barrel 16 and the barrel 16 in the housing 14; and that type retention, and that by components 72, 78, and 98, has been described.

The formed internal lip 66 on the breechward end of the housing 14 provides a non-movable shoulder safety stop for the firing pin 36's assembly, making it impossible for parts of the assembly to accidental eject out of the breechward end of the housing 14 due to a "backfire" of the power load 34. The simplified firing pin assembly 36 can be inserted into the housing 14 from the muzzleward end 134a, and removed for repair by forcing the assembly 36 in reverse, i.e., muzzlewardly.

The simplified combination of a one-piece barrel 14 and muzzle 18 provides a much stronger unit; and the formed configuration 14/18 allows the piston 80 to "bottom" out on the muzzle portion 18 without causing the barrel portion 16 to expand to the point of becoming inoperable.

The improved barrel slot 104 has an enlarged opening 136 in the breechward end to allow the improved piston detect pin 102 to be inserted (while the barrel 16 and housing 14 are in separated condition as in FIG. 8). With the chamber body 30 or 30a or 30b then in place, the pin 102 cannot escape outwardly through the barrel slot 104 when the barrel 16 is removed from the housing 14, due to the breechward position of that opening 136; but when the chamber body is moved breechwardly, the pin 102 can be released through the barrel slot 104, because the registration of the pin 102 with the enlarged opening 136 causes the shoulder lugs 114 to be no longer blocked by the edges 116 of the barrel slot 104.

The improved chamber body 30a or 30b with the sliding (offset from the center bore 32) pin 142 or 145 provides a number of improvements, including a positive, precision positioning of the piston 80 and thus also the piston's ejection nib 130, in relation to firing pin 36's guide spool body 44 and to the chamber body 30a or 30b when the tool 12 is in the firing position, regardless of operator error in not holding the tool 12 firmly enough against a work surface 22/26 prior to and thus at the instant of firing, or not holding it still firmly against the work until the firing operation is completed. This positioning of the piston 80 and ejection nib 130 results in maximum power, eliminates "backfire", and prevents the piston 80's rebound (breechwardly) from a power stroke to re-enter the chamber body bore 32 while still in the firing position, which would thereby crush the spent power load 34 still in the chamber bore 32 making it possible to then be ejected.

The firing pin 36 has its forward end 40 kept centered and guided by being slidable in the bore 43 of a spool-like control body 44; and the breechward face 76 of the bore 43 and the outer central surface 70 of the body 44 are grooved, respectively receiving retainer rings 78 and 72, the ring 72 yieldably retaining the body 44 in the housing bore 15 and the ring 78 yieldably retaining the compression means 54 on the firing pin 36 during assembly, yet both rings 78 and 72 are yieldable accommodating the desired movement of the parts.

The spacer sleeve 50's muzzleward and 48 provides a fixed housing abutment which blocks breechward movement of the firing pin control body 44 during tool-cocking, preventing the full coil-turn to coil-turn engagement of the outer firing pin spring 60 which can cause its deterioration as the rear end 66/52 of the housing 14 receives the repetitive dynamic shock of blows of the firing hammer.

These various features of novelty contribute advantages not only individually but in synergistically advantageous combination with one another and with the features and details of the tool; and even though the tool in all of these embodiments uses and builds upon the long-utilized and long-basic components of barrel muzzle, piston, housing, power load chamber, and firing pin, nevertheless the several features of novelty here presented achieve distinct improvements and concepts quite beyond what the prior art of these tools has achieved throughout the many years knowledge and use of these tools.

CONCLUSION

It is thus seen that a hammer-activated power tool device, constructed and used according to the inventive concepts herein set forth, provides novel concepts of a desirable and advantageous device, yielding the advantages of a power tool which provides special and particular advantages as pointed out.

In summary as to the nature of these advantageous concepts, their inventiveness is shown by novel features of concept and construction shown herein, and by the novel concepts hereof not only being different from all the prior art known, but because the achievement of each of the concepts is not what is or has been suggested to those of ordinary skill in this active and competitive art, especially realistically considering this as comprising components which individually are similar in nature to what is well known to most persons of the art surely including most of the many makers and users of this specialized type of tool for many years in industrial nations. No prior art, however, has suggested the modifications of any prior art to achieve the novel concepts here achieved, with the effects which the tool with these concepts provides.

The special particulars of concept and construction are specified herein, yielding novel advantages especially in this type of power tool, even though many and different types of these power tools of various other natures have been known for years; and quite certainly no particular combination achieved by the components and concepts as here presented has been suggested by the prior art, and thus the novel concepts of this embodiment provide achievements which are substantial and advantageous departures from prior art, even though the prior art in this field shows attempts at improvement for many years. And particularly is the overall difference from the prior art significant when the non-obviousness is viewed by a consideration of the subject matter as a whole, as integrally incorporating the features different from the prior art, in contrast to merely those details of novelty themselves, and further in view of the differences of these concepts from prior art particulars show that it must be realistically seen that the prior art has been teaching away from the concepts of this invention, and that the trend of the prior art in these particulars has been away from these concepts.

Accordingly, it will thus be seen from the foregoing description of the invention according to this illustrative embodiment, considered with the accompanying drawings, that the present invention provides new and useful concepts of a novel and advantageous power tool having and yielding desired advantages and characteristics in formation and use, and accomplishing the intended objects, including those hereinbefore pointed out and other which are inherent in the invention.

Modifications and variations may be effected without departing from the scope of the novel concepts of the invention; accordingly, the invention is not limited to the specific embodiments, or form or arrangement of parts herein described or shown.

I claim:

1. A cartridge-actuated fastener-driving tool of a type having a generally tubular housing body means in which is slidably carried a generally tubular barrel means having a muzzle, the barrel means carrying adjacent its breechward end a chamber body having a bore within which may be placed a power cartridge which is operative, when struck, to forcibly drive the fastener outwardly of a muzzle, a firing pin being slidably carried by the housing body means, and operative when struck by an associated hammer means to strike the power cartridge to cause its fastener-driving tool operativity by propelling a piston means slidably carried in the bore of the barrel means to forcibly engage the fastener, the improvement for such a tool, comprising:

the housing body means being provided with an axially-extending offset wall means having an abutment at the muzzleward end thereof, the barrel means being provided with an axially-extending slot, and the piston means being provided with a pin means which has a position in which it extends through the barrel means slot and toward the offset wall means far enough to abuttingly engage the said abutment, the abutting engagement of the pin means with the muzzleward abutment providing, depending on the relative position of the relatively movable housing body means, barrel-means and piston means: (a) a force means which pulls the piston means breechwardly to achieve ejection of a spent power cartridge and achieve maximal effect of the explosion of the next power cartridge if the operator pulls the housing body means and the barrel means relatively apart, or (b) a force means which limits relatively apart movement of the housing body means and the barrel means.

2. A fastener-driving tool according to claim 1, in a combination in which the said pin means is movable for permitting separation of the barrel means from the housing body means by avoiding abutment of the pin means from the said muzzleward abutment, and the said offset wall means is provided with an access opening means adjacent the said muzzleward abutment for providing access to the pin means to achievement its movement to avoid abutting engagement of the said muzzleward abutment.

3. A fastener-driving tool according to claim 2, in a combination in which the provision of the piston means with the said pin-means includes a spring means which urges the pin means outwardly, assuring its outward position such as to abuttingly engage the said muzzleward abutment for achieving its function of limiting the relatively apart movement of the housing body means and the barrel means, but permitting the pin means to be forced inwardly of the piston means, by access through the said opening means, an amount sufficient to provide its said avoidance of abutting engagement with the said muzzleward abutment.

4. A fastener-driving tool according to claim 3, in a combination in which the said spring means are sufficiently forceful as to cause a sufficient reaction force in the piston means, when the pin means is being pressed by the spring means to push outwardly onto the said offset wall, sufficient to cause a sufficient bearing of the piston means against the barrel means to significantly although releasably retard relative sliding movement thereof, and also to cause a sufficient bearing of the barrel means against the housing body means to significantly although releasably retard relative sliding movement thereof.

5. A fastener-driving tool according to claim 2, in a combination in which the pin means is provided with abutment lug means which, in a condition of separation of the barrel means from the housing body means such that the said offset wall means of the housing body means would not be retaining the pin means against outward movement, engage the edges of the barrel means slot to block outward movement of the pin means through the slot.

6. A fastener-driving tool according to claim 5, in a combination in which there is provided a pin-assembly and pin-disassembly hole in the barrel means, within the span of its said slot, of a size to pass the pin means through said hole, and providing in the region of the said hole that the abutment lug means of the pin means will not be blocked by the slot edges.

7. A fastener-driving tool according to claim 6, in a combination in which the chamber body is movable breechwardly from its position in which it operatively receives a power cartridge for fastener-driving operativity;

and the said pin-assembly and pin-disassembly hole is located far enough breechwardly of the barrel means that the piston means cannot be moved relative to the barrel means such that the pin means comes into registration with the said pin-assembly and pin-disassembly hole sufficient to permit outward passage of the pin means through the hole unless the chamber body is moved breechwardly from its said position of fastener-driving operativity.

8. A fastener-driving tool according to claim 7, in a combination in which the breechward movement of the piston means relative to the barrel means is limited by the operative engagement of the breechward end of the piston means with the muzzleward end of the chamber body, that engagement preventing registration of the pin means with the pin-assembly and pin-disassembly hole unless the chamber body is moved breechwardly as aforesaid.

9. A fastener-driving tool according to claim 8, in a combination in which the pin means abutment lugs are provided by the pin means being provided to have outwardly-facing shoulders, the pin means otherwise being generally cylindrical and of a diameter greater than the width of the barrel means slot but less than the diameter of the pin-assembly and pin-disassembly hole, and the thickness of the pin means in its outer portion outwardly adjacent the said shoulders being smaller than the width of the barrel means slot.

10. A fastener-driving tool according to claim 1, including an associated spring for biasing the firing pin muzzlewardly, in a combination in which the tubular housing body means is provided at its breechward end with an inturned lip or flange, providing a housing abutment of fixed nature which provides a bottom against which the associated spring of the firing pin bottoms, the housing body means being provided to be open clear thereto from its muzzleward end to accommodate installation of the firing pin and whatever are its associated components breechwardly of its cartridge-striker face to be installed into and removed from the housing body means through the muzzleward end of the housing body means.

11. A fastener-driving tool according to claim 10, in a combination in which the lip or flange is provided as an integral continuation of the wall of the housing body means.

12. A fastener-driving tool according to claim 1, in a combination in which the barrel means and the muzzle are formed as an integral continuation of one another.

13. A fastener-driving tool according to claim 1, in a combination in which the piston means carries an ejector nib on its breechward end, and the firing pin has parts associated with it;

and the chamber body has a supplementary axial bore; and a supplemental chamber body pin is slidably carried in the said supplemental axial bore;

the said supplemental pin being longer than the operative axial length of the chamber body an amount just greater than the axial length of the ejector nib, thereby providing that the supplemental pin will be abutted by one of the firing pin's associated parts or by the breechward end of the piston means, either (a) forcing the ejector nib out of the power cartridge bore of the chamber body while the firing pin's associated parts are in a position in which the firing pin would operatively strike a power cartridge while the latter is in the power cartridge bore of the chamber body, or (b) forcing the firing pin's associated parts breechwardly away from the chamber body.

14. A fastener-driving tool according to claim 13, in a combination in which there are provided means for retaining the supplemental chamber body pin from full removal, in either direction, from the chamber body.

15. A fastener-driving tool according to claim 14, in a combination in which the retaining means comprise the provision of a head on each end of the said supplemental pin:

16. A fastener-driving tool according to claim 14, in a combination in which the retaining means comprise the provision of an opening means radially inwardly of the chamber body to the supplementary axial bore of the chamber body, the said supplemental pin being provided with spaced walls facing axially inwardly, and there being a retainer means disposed in the radially inward opening means for blocking axial movement of the supplemental pin in either axial direction by engagement of one or the other of the pin walls, but permitting axial movement of the supplemental pin in either axial direction for the operativity as aforesaid.

17. A fastener-driving tool according to claim 16, in a combination in which the said opening means radially inwardly of the chamber body is provided by providing around the chamber body an annular groove of a diameter such that it intersects the radially outer portion of the said supplemental bore, and the retainer means being a ring seated in said groove and having a portion of the ring engageable with the pin walls.

18. A fastener-driving tool according to claim 17, in a combination in which the retainer means is an O-ring.

19. A fastener-driving tool according to claim 18, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

20. A fastener-driving tool according to claim 17, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

21. A fastener-driving tool according to claim 16, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

22. A fastener-driving tool according to claim 1, in a combination in which the firing pin is provided with a control body having an axial bore in which the firing pin is ensleeved, and the said control body's outer surface is provided with a groove means between inwardly-facing wall means, and there is provided a retainer ring means in said groove means, the retainer ring means providing a frictional drag against the bore of the housing body means, and by abutment of the breechward one of the control body wall means releasably prevents the firing pin and its said control body and its other parts breechward of its striker face from sliding muzzlewardly with respect to the housing body means unless the firing pin is purposefully forced muzzlewardly.

23. A fastener-driving tool according to claim 22, in a combination in which the two said control body's inwardly facing wall means are generally of the same diameter and are axially spaced thus maintaining the firing pin control body against being cocked in the housing bore, and thus providing a centering effect for the firing pin ensleeved by the control body bore.

24. A fastener-driving tool according to claim 23, in a combination in which the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

25. A fastener-driving tool according to claim 24, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means, 26. A fastener-driving tool according to claim 23, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

27. A fastener-driving tool according to claim 22, in a combination in which the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

28. A fastener-driving tool according to claim 27, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

29. A fastener-driving tool according to claim 22, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

30. A fastener-driving tool according to claim 1, in a combination in which the firing pin is provided with a control body in which the firing pin is ensleeved, and the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

31. A fastener-driving tool according to claim 30, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

32. A fastener-driving tool according to claim 1, in which the firing pin is provided with a control body movable relative to the firing pin and to the housing body means, and there is a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

33. A cartridge actuated fastener-driving tool of a type having a generally tubular housing body means to which is fixedly connected a handle, and in which is slidably carried a generally tubular barrel means having a muzzle, the barrel means carrying adjacent its breechward end a chamber body having a bore within which may be placed a power cartridge which is operative, when struck, to forcibly drive the fastener outwardly of the muzzle, a firing pin being slidably carried by the housing body means and ensleeved within an associated spring which biases the firing pin in a muzzleward direction, the firing pin being operative when struck by an associated hammer means to move muzzlewardly and thereby to strike the power cartridge to cause its fastener-driving operativity by propelling a piston means slidably carried in the bore of the barrel means to forcibly engage the fastener, the improvement for such a tool, comprising the provision that the tubular housing body means is provided at its breechward end with an inturned lip or flange, providing a housing abutment of fixed nature which provides a bottom against which the associated spring of the firing pin bottoms, and which bottoms the associated spring wholly independently of the handle, but nevertheless the lip or flange providing that the firing pin may move muzzlewardly relatively to the housing yet retaining and blocking against breechward movement of the firing pin, the lip or flange providing a fixed stop which blocks breechward movement of a spacer sleeve mentioned below, the firing pin carrying an abutment which is engaged with the spacer sleeve for providing the retaining and blocking of breechward movement of the firing pin, the housing body means being provided to be open clear thereto from its muzzleward end to accommodate installation of the firing pin and whatever are its associated components breechwardly of its cartridgestriker face to be installed into and removed from the housing body means through the muzzleward end of the housing body means.

34. A fastener-driving tool according to claim 33, in a combination in which the lip or flange is provided as an integral continuation of the wall of the housing body means.

35. A cartridge-actuated fastener-driving tool of a type having a generally tubular housing body means in which is slidably carried a generally tubular barrel means having a muzzle, the barrel means carrying adjacent its breechward end a chamber body having a bore within which may be placed a power cartridge which is operative, when stuck, to forcibly drive the fastener outwardly of the muzzle, a firing pin being slidably carried by the housing body means, and operative when struck by an associated hammer means to strike the power cartridge to cause its fastener-driving operativity by propelling a piston means slidably carried in the bore of the barrel means to forcibly engage the fastener, the piston means of the tool carrying an ejector nib on its breechward end, and the tool's firing pin has parts associated with it;

the improvement for such a tool, comprising the provision of the chamber body with a supplementary axial bore; and a supplemental chamber body pin is slidably carried in the said supplemental axial bore, the said supplemental pin being longer than the operative axial length of the chamber body an amount just greater than the axial length of the ejector nib, thereby providing that the supplemental pin will be abutted by one of the firing pin's associated parts or by the breechward end of the piston means, either (a) forcing the ejector nib out of the power cartridge bore of the chamber body while the firing pin's associated parts are in a position in which the firing pin would operatively strike a power cartridge while the latter is in the power cartridge bore of the chamber body, or (b) forcing the firing pin's associated parts breechwardly away from the chamber body.

36. A fastener-driving tool according to claim 35, in a combination in which there are provided means for retaining the supplemental chamber body pin from full removal, in either direction, from the chamber body.

37. A fastener-driving tool according to claim 36, in a combination in which the retaining means comprise the provision of a head on each end of the said supplemental pin.

38. A fastener-driving tool according to claim 36, in a combination in which the retaining means comprise the provision of an opening means radially inwardly of the chamber body to the supplementary axial bore of the chamber body, the said supplemental pin being provided with spaced walls facing axially inwardly, and there being a retainer means disposed in the radially inward opening means for blocking axial movement of the supplemental pin in either axial direction by engagement of one or the other of the pin walls, but permitting axial movement of the supplemental pin in either axial direction for the operativity as aforesaid.

39. A fastener-driving tool according to claim 38, in a combination in which the said opening means radially inwardly of the chamber body is provided by providing around the chamber body an annular groove of a diameter such that it intersects the radially outer portion of the said supplemental bore, and the retainer means being a ring seated in said groove and having a portion of the ring engageable with the pin walls.

40. A fastener-driving tool according to claim 39, in a combination in which the retainer means is an O-ring.

41. A fastener-driving tool according to claim 40, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

42. A fastener-driving tool according to claim 39, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

43. A fastener-driving tool according to claim 38, in a combination in which the retainer is a resiliently deformable body means, a portion of which is pressed into the opening in the region of its intersection with the said supplemental bore of the chamber body by the resilient deformation imparted to it by its carry on the chamber body imparting resilient deformation to it.

44. A cartridge-actuated fastener-driving tool of a type having a generally tubular housing body means in which is slidably carried a generally tubular barrel means having a muzzle, the barrel means carrying adjacent its breechward end a chamber body having a bore within which may be placed a power cartridge which is operative, when struck, to forcibly drive the fastener outwardly of the muzzle, a firing pin being slidably carried by the housing body means, and operative when struck by an associated hammer means to strike the power cartridge to cause its fastener-driving operativity by propelling a piston means slidably carried in the bore of the barrel means to forcibly engage the fastener, the firing pin being provided with a control body having an axial bore in which the firing pin is ensleeved, the improvement for such a tool, comprising the provision that the said control body's outer surface is provided with a groove means between inwardly-facing wall means, and there is provided a retainer ring means in the said groove means, the retainer ring means providing a frictional drag against the bore of the housing body means, and by abutment of the breechward one of the control body wall means releasably prevents the firing pin and its said control body and its other parts breechward of its striker face from sliding muzzlewardly with respect to the housing body means unless the firing pin is purposefully forced muzzlewardly.

45. A fastener-driving tool according to claim 44, in a combination in which the two said control body's inwardly-facing wall means are generally of the same diameter and are axially spaced thus maintaining the firing pin control body against being cocked in the housing bore, and thus providing a centering effect for the firing pin ensleeved by the control body bore.

46. A fastener-driving tool according to claim 45, in a combination in which the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

47. A fastener-driving tool according to claim 46, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

48. A fastener-driving tool according to claim 45, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

49. A fastener-driving tool according to claim 44, in a combination in which the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

50. A fastener-driving tool according to claim 49, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

51. A fastener-driving tool according to claim 45, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

52. A cartridge-actuated fastener-driving tool of a type having a generally tubular housing body means in which is slidably carried a generally tubular barrel means having a muzzle, the barrel means carrying adjacent its breechward end a chamber body having a bore within which may be placed a power cartridge which is operative, when struck, to forcibly drive the fastener outwardly of the muzzle, a firing pin being slidably carried by the housing body means, and operative when struck by an associated hammer means to strike the power cartridge to cause its fastener-driving operativity by propelling a piston means slidably carried in the bore of the barrel means to forcibly engage the fastener, the firing pin being provided with a control body having an axial bore in which the firing pin is ensleeved, the improvement for such a tool, comprising the provision that the bore of the control body from and inwardly of its breechward end is provided with an axially-extending counterbore;

and the firing pin is provided with a retainer ring means which serves as an abutment lug holding spring means associated with the firing pin prior to and during assembly of the firing pin into the housing bore, and the said counterbore provides for the reception of the said retainer ring means as the firing pin is moved muzzlewardly with respect to the said control body during firing of the tool.

53. A fastener-driving tool according to claim 52, in which the firing pin is provided with a compression spring means which bottoms against the housing body means to bias the firing pin in a muzzleward direction, in a combination in which the housing body means is provided at its breechward end with a fixed spacer sleeve;

and the muzzleward end of the said spacer sleeve provides a fixed housing abutment of a fixed location relative to the housing body means, which blocks breechward movement of the firing pin control body during a forced movement of the barrel means breechwardly relative to the housing body means, during which movement of the barrel means and barrel means operatively pushes breechwardly against the firing pin control body to compress the said spring means, the said blocking thereof by the said fixed housing abutment being operative to prevent continued compression of the spring means.

54. A cartridge-actuated fastener-driving tool of a type having a generally tubular housing body means in which is slidably carried a generally tubular barrel means having a muzzle, the barrel means carrying adjacent its breechward end a chamber body having a bore within which may be placed a power cartridge which is operative, when struck, to forcibly drive the fastener outwardly of the muzzle, a firing pin being slidably carried by the housing body means, and operative when struck by an associated hammer means to strike the power cartridge to cause its fastener-driving operativity by propelling a piston means slidably carried in the bore of the barrel means to forcibly engage the fastener, the tool being of a type in which its firing pin is provided with a control body movable relative to the firing pin and to the housing body means, and there is a compression spring means which bottoms against the housing body means to bias the firing pin in a muzzleward direction, the improvement for such a tool, comprising the provision of the housing body means at its breechward end with a fixed spacer sleeve;

and the muzzleward end of the said spacer sleeve provides a fixed housing abutment of a fixed location relative to the housing body means, which blocks breechward movement of the firing pin control body and of the barrel during a forced movement of the barrel means breechwardly relative to the housing body means, during which movement of the barrel means the barrel means operatively pushes breechwardly against the firing pin control body to compress the said spring means, the said blocking thereof by the said fixed housing abutment being operative to prevent continued compression of the spring means.

55. A fastener-driving tool according to claim 1, in a combination in which the said offset wall means also has an abutment at the breechward end thereof, the pin means of the piston means having a position in which it extends through the barrel means slot and toward the offset wall means far enough to abuttingly engage the said breechward abutment, and the abutting engagement of the pin means with the breechward abutment providing, depending on the relative position of the relatively movable housing body means, barrel-means and piston means: (a) a blocking of the amount the barrel means and the piston means can move breechwardly, such as in a toolcocking maneuver of pushing the tool against the associated work object, thereby preventing the piston means from having its ejector nib from entering the bore of the chamber body, or (b) a recoil of the piston means which might otherwise cause the piston means to move breechwardly so far as to permit the piston means ejector nib from entering the said chamber body bore prior to the withdrawal of the firing pin from cartridge-exploding position an amount sufficient to assure an open path for ejector of a spent cartridge.

* * * * *